US005937840A

United States Patent [19]

Winton

[11] Patent Number: 5,937,840

[45] Date of Patent: Aug. 17, 1999

[54] LAUNCHING APPARATUS FOR ARCHERY BOWS AND ARROWS

[76] Inventor: Carl D. Winton, 733 Milton, Angleton, Tex. 77515

[21] Appl. No.: 09/039,676

[22] Filed: Mar. 16, 1998

[51] Int. Cl.[6] ..... F41B 5/00

[52] U.S. Cl. ..... 124/24.1

[58] Field of Search ..... 124/23.1, 24.1, 124/25.6, 86, 88, 44.5

[56] References Cited

U.S. PATENT DOCUMENTS

| | | | |
|---|---|---|---|
| 2,944,539 | 7/1960 | Wheeler | 124/24.1 X |
| 4,027,645 | 6/1977 | Damron | 124/24.1 |
| 4,829,974 | 5/1989 | Anderson | 124/24.1 |
| 5,263,465 | 11/1993 | Anderson | 124/24.1 |
| 5,520,163 | 5/1996 | Hurd | 124/24.1 |

*Primary Examiner*—John A. Ricci
*Attorney, Agent, or Firm*—Harrison & Egbert

[57] ABSTRACT

An improved archery bow and drawstring with the improvement being a ring-like member attached to the bow, and a tubular member slidably received within the ring-like member. The tubular member has an open end opening outwardly of the bow and the ring-like member. The tubular member is fixedly secured to the drawstring at an opposite end. The tubular member has a pin formed therein so as to extend transverse to a longitudinal axis of the tubular member. The ring-like member is affixed to a handle of the bow. An arrow having a shaft is slidably received within an interior of the tubular member. The arrow has a head which extends outwardly of the open end of the tubular member. The arrow has a lock which is releasably received over the pin.

18 Claims, 2 Drawing Sheets

FIG. 1
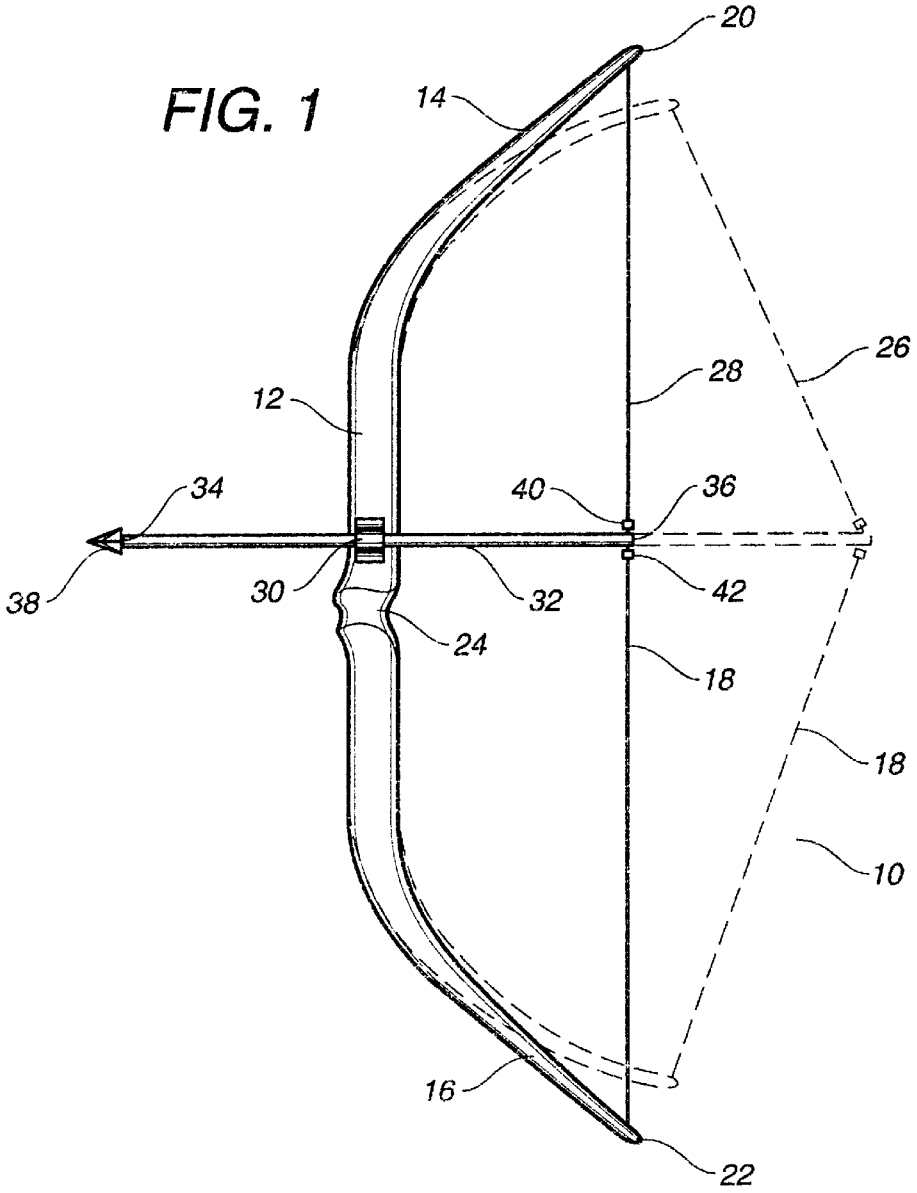
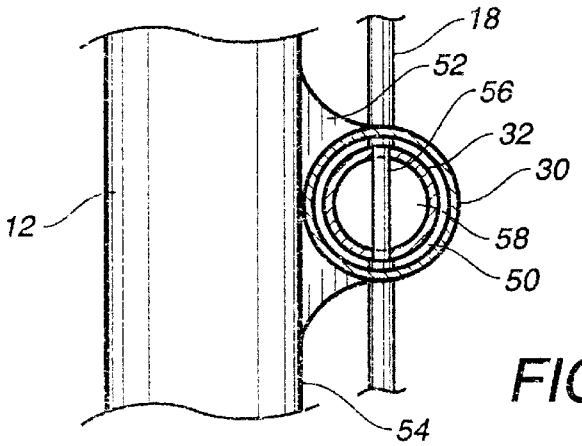
FIG. 2

LAUNCHING APPARATUS FOR ARCHERY BOWS AND ARROWS

TECHNICAL FIELD

The present invention relates to archery bows and drawstrings. More particularly, the present invention relates to apparatus for launching arrows from such archery bows. Furthermore, the present invention relates to apparatus which launch the arrow by "pulling" the arrow from the archery bow, as opposed to conventional apparatus which "push" the arrow from the bow.

BACKGROUND ART

In the sport of archery, conventional bows are often used with conventional arrows. With conventional arrows, the rear end of a conventional arrow is placed against the bow string, and the bow string is pulled back. The front end of the arrow slides against the bow until the arrow head is near the bow. Then the bow string is released, and the arrow is shot. To span the distance from the rear end of the arrow to the arrow head, conventional arrows must be a certain conventional length. Such conventional length arrows are relatively heavy and have an inherent limitation as to the distance they can travel without dropping in elevation. Often such conventional length arrows are approximately thirty-one inches long. A plurality of conventional length arrows weighs a certain weight that is relatively heavy and occupies a certain space that is relatively large. Therefore, in view of the above, it would be desirable to provide a bow and arrow combination that employed arrows that are shorter than conventional length. By using arrows that are shorter than conventional length and of a lighter weight, a person can readily carry more arrows along when engaging in archery. Moreover, arrows that are shorter and of a lesser weight permit a greater travel distance without a drop in elevation.

It is conceivable that a person could attempt to employ an arrow that is shorter than conventional length with a conventional bow. If such were done, the bow string could not be pulled back far enough to provide an effective stretch of the bow and bow string to propel the shorter than conventional length arrow effectively. Therefore, it would be desirable to provide a bow and bow string that can be sufficiently stretched to effectively propel a shorter than conventional length arrow.

There are currently many conventional bows which employ conventional length arrows in use. It would be desirable, therefore, to be able to readily convert a conventional bow into a novel bow that can be employed to launch shorter than conventional length arrows.

A rear end of a conventional arrow generally includes a slot into which the bow string fits. Sometimes, however, there is a binding between the slot and the bow string, and the arrow does not cleanly release from the bow string. As a result, the arrow does not fly as far and as straight as desired. In this respect, it would be desirable if arrows can be provided which permit an arrow to be propelled by a bow string without securing the slot to the bow string.

Generally, with a conventional arrow and a conventional bow, the rear end of the arrow is pinched between the index finger and the thumb, and the pinched arrow is pulled back in order to stretch the bow string. Such a pinching and pulling operation may be very tiring. Moreover, with such a pinching and pulling operation, it may be quite difficult for a person to muster sufficient pinching and pulling strength to pull the bow string back a suitable distance to provide a suitable tension in the bow string. In this respect, it would be desirable if the rear end of an arrow and the bow string could be pulled back without using a pinching and pulling action on the rear end of the arrow.

It is an object of the present invention to provide an improved launching apparatus for an archery bow which serves to direct the arrow accurately and with high velocity from the bow.

It is another object of the present invention to provide an improved launching apparatus for an archery bow which decreases the trajectory of the arrow and gives a flatter flight path.

It is another object of the present invention to provide an improved launching apparatus which causes the arrow to be launched in a more accurate manner.

It is another object of the present invention to provide an improved launching apparatus which eliminates the need to pinch and pull the drawstring during launching.

It is another object of the present invention to provide an improved launching apparatus which allows for the use of shorter arrows formed of lighter weight material than conventional arrows.

It is a a further object of the present invention to provide an improved launching apparatus which allows arrows to be launched that have improved aerodynamics.

These and other objects and advantages of the present invention will become apparent from a reading of the attached specification and appended claims.

SUMMARY OF THE INVENTION

The present invention is an improved launching mechanism for an archery bow and drawstring. The improvement of the present invention includes a ring-like member which is attached to a bow, and a tubular member that is slidably received within the ring-like member. The tubular member has an open end opening outwardly of the bow and the ring-like member. The tubular member is fixedly secured to the drawstring at an end opposite the open end. The tubular member has a pin formed therein so as to extend transversely to a longitudinal axis of the tubular member.

Specifically, in the present invention, the ring-like member is affixed to a handle of the bow in an area between an upper limb and a lower limb of the bow. The ring-like member has an interior with a longitudinal axis coaxial with a longitudinal axis of the tubular member. The ring-like member controls the movement of the tubular member so as to prevent dangerous reactions of the tubular member during and following the launching of the arrow.

The present invention includes a first fitting which is secured to the drawstring above the tubular member, and a second fitting which is affixed to the drawstring below the tubular member. The first and second fittings serve to fix a position of the end of the tubular member along a length of the drawstring. The tubular member has a solid area at an end opposite the open end. The solid area has a cavity formed around the drawstring. The cavity has a generally V-shaped configuration on a side adjacent the open end. The cavity has a straight side opposite the V-shaped configuration.

In the present invention, an arrow is provided that has a shaft which is slidably received within an interior of the tubular member. The arrow has a head which extends outwardly of the tubular member. The arrow has a nock releasably received over the pin on the interior of the tubular member. The arrow has feathers or plastic fletchings which extend radially outwardly of the shaft. The fletchings serve to contact an inner wall of the tubular member. The shaft of the arrow associated with the present invention has a length less than a distance of the handle of the bow from the drawstring. The arrow can have a head which is detachably affixed to the shaft. The arrow can also include a weighted member affixed to the shaft rearwardly of the head for added stability and for additional penetration when desired.

BRIEF DESCRIPTION OF THE DRAWINGS

FIG. 1 is a side elevational view showing the improved archery bow in accordance with the present invention.

FIG. 2 is an end view of the archery bow of the present invention showing the improved launching apparatus.

DETAILED DESCRIPTION OF THE INVENTION

Figure 3:
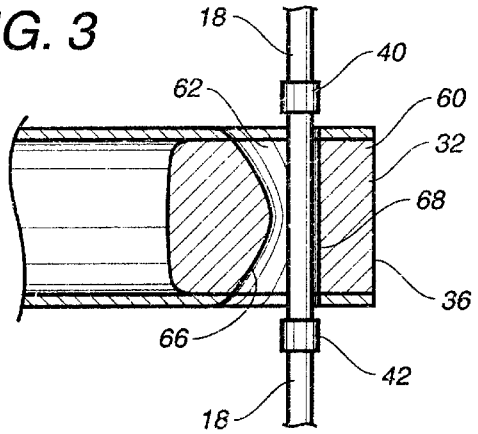
FIG. 3 is a cross-sectional view showing the attachment of the tubular member to the drawstring of the bow.

Referring to FIG. 1, there is shown at 10 the improved archery bow apparatus in accordance with the teachings of the present invention. The archery bow apparatus 10 includes a bow 12 having an upper limb 14 and a lower limb 16. A drawstring 18 will extend between end 20 of the upper limb 14 and end 22 of the lower limb 16. A handle 24 is formed on the bow 12 between the upper limb 14 and the lower limb 16. In FIG. 1, it can be seen that the drawstring 18 is shown in a pre-launching position 26 (in broken line fashion) and a post-launching (or static) position 28 (shown in solid line fashion).

In the present invention, the improvement to the archery bow apparatus 10 includes a ring-like member 30 which is attached to the bow 12 in the area of handle 24. A tubular member 32 is slidably received by the ring-like member 30. The ring-like member 30, in the preferred embodiment, is a tubular member. However, and alternatively, the ring-like member 30 can be a receptacle or a ring which encircles a portion of the outer diameter of the tubular member 30.

The ring-like member 30 is affixed to the handle 24 of bow 12. The ring-like member 30 will have a longitudinal axis which is coaxial with the longitudinal axis of the tubular member 30. The longitudinal axis of the ring-like member 30 will extend generally transverse to the length of the bow 12. The ring-like member 30 is securely affixed to one side of the handle 24 of the bow 12.

The tubular member 32 has an open end 34 which opens outwardly of the bow 12 and the ring-like member 30. The tubular member 32 has an end 36 which is fixedly secured to the drawstring 18. The end 36 is at an end of the tubular member 32 opposite the open end 34. As will be described hereinafter, the tubular member 32 will have a pin formed therein so as to extend transverse to the longitudinal axis of the tubular member 32. This pin will serve to receive the nock of an arrow 38 positioned on the interior of the tubular member 32.

As can be seen in FIG. 1, the drawstring 18 includes a first fitting 40 which is affixed to the drawstring 18 above the end 36 of tubular member 32. A second fitting 42 is affixed to the drawstring 18 below the end 36 of tubular member 32. The fittings 40 and 42 serve to position the end 36 of tubular member 32 in a desired position relative to the length of the drawstring 18. Ideally, the fittings 40 and 42 will serve to center the end 36 of the tubular member 32 such that the tubular member 32 will slide freely and smoothly through the ring-like member 30 during the launching of arrow 38.

It can be seen in FIG. 1 that, in order to launch the arrow 38, the drawstring 18 is pulled backwardly in a conventional fashion. Since the end 36 is securely affixed to the drawstring 18, the archery bow 10 does not require the "pinching and pulling" action of conventional bow designs. It is only necessary to pull the drawstring 18 rearwardly such that the end 34 of tubular member 32 will reside in proximity to the ring-like member 30. When the bow apparatus 10 is properly aimed at the desired target, the drawstring 18 can be released so that the drawstring 18 moves to its "post-launching" position (illustrated in solid line fashion). The movement of the drawstring 18 from position 26 to position 28 (or further inwardly) will cause the tubular member 32 to be propelled through the interior of the ring-like member 30. Eventually, the drawstring 18 will come to an immediate stop. When the drawstring 18 comes to the "stop" position, the tubular member 32 will immediately stop. As such, the velocity of the arrow 38 within the interior of the tubular member 32 will cause the arrow 38 to be propelled outwardly of the tubular member 32 in a straight and fast manner. The positioning of the tubular member 32 within the ring-like member 30 assures that the arrow 38 will travel in a straight manner. The ring-like member 30 also assures safety during the launching. The ring-like member will prevent the tubular member 32 from flopping around and reacting wildly during the launching of an arrow.

FIG. 2 shows how the ring-like member 30 is secured to the bow 12. As can be seen, the ring-like member 30 has an interior opening 50 which receives the tubular member 32 therein. A suitable bracketing member 52 is used so as to affix the ring-like member 30 securely to the side 54 of bow 12. The tubular member 32 resides in coaxial relationship to the ring-like member 30. It can be seen that pin 56 extends through the interior of the tubular member 32 generally transverse to the longitudinal axis of the tubular member 32. The pin 56 extends radially on the interior of the tubular member 32. The pin 56 extends through the wall of the tubular member 32 and is braded or riveted so as to be properly retained in place. Pin 56 is designed so as to receive the nock of an arrow received on the interior of the tubular member 32. Drawstring 18 is illustrated as extending behind the rear of the tubular member 32 and the ring-like member 30. Since the tubular member 32 is solid at the end 36, the drawstring is illustrated as hidden from view relative to the interior 58 of the tubular member 32.

FIG. 3 shows the manner in which the tubular member 32 is affixed to the drawstring 18. As can be seen in FIG. 3, the first fitting 40 is affixed to the drawstring 18 above the tubular member 32. The second fitting 42 is positioned below the end 36 of tubular member 32. The second fitting 42 is also affixed to the drawstring 18. As can be seen, the tubular member 32 has its end 36 positioned between the fittings 40 and 42 such that the end 36 is aligned with the ring-like member 30.

It can be seen in FIG. 3 that the ends 36 of tubular member 32 includes a solid area 60 therein. A cavity 62 is formed in the solid area 60. The drawstring 18 will extend through the cavity 62 within the solid area 60. The solid area 60 is formed so as to prevent a cutting or fraying of the drawstring 18 during repeated use. The cavity 62 has one side 66 of a generally V-shaped configuration. The curvature of this V-shaped configuration on side 66 allows for the curvature of the drawstring 18 during launching. The curvature of side 66 of cavity 62 will conform to the curvature of the drawstring 18 so as to maximize the surface area contact between side 66 and the surface of the drawstring 18 on the interior of cavity 62. Another side 68 of cavity 62 is a straight side. It has been found that a maximizing of the surface area contact between side 66 and the surface of drawstring 18 further enhances the accuracy of the launching of the arrow 34 and facilitates the consistent and even motion of the tubular member 32 through the ring-like member 30. This curvature further avoids any unnecessary destruction of the drawstring 18 during repeated use.

Figure 4:
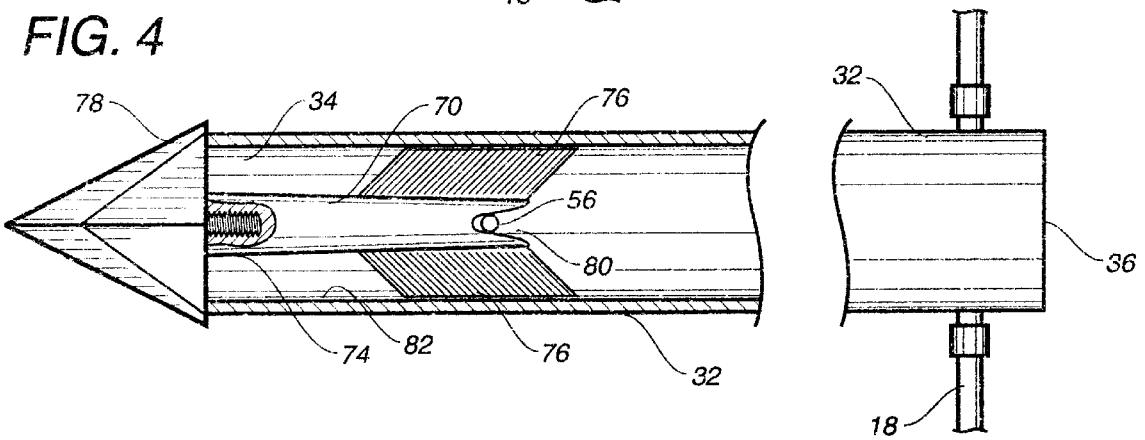
FIG. 4 is a diagrammatic illustration of how the arrow is received within the interior of the tubular member.

FIG. 4 shows how an arrow 70 is received on the interior of tubular member 32. It can be seen in FIG. 4 that the arrow 70 includes a shaft 74 extending so as to be longitudinally aligned with the tubular member 32. The shaft 74 has fletchings 76 extending outwardly on an end of the shaft 74 opposite head 78. A nock 80 is formed at the end of shaft 74 behind the attachment of the fletchings 76 to the shaft 74. Nock 80 is releasably received by pin 56 on the interior of the tubular member 32. The fletchings 76 extend outwardly such that an edge of the fletchings 76 contacts an interior surface 82 of the tubular member 32. Experimentation has found that the fletchings 76 will slide smoothly and evenly outwardly of the tubular member 32 during launching. It has been found that the positioning of the fletching in the tubular member properly centers the shaft 74 so that the arrow is propelled accurately outwardly.

FIG. 4 further shows how the drawstring 18 is attached to the end 36 of the tubular member 32. In FIG. 4, the head 78 of arrow 70 extends outwardly of the open end 34 of tubular member 32. Head 78 will have an end abutting the edge of the open end 34. The open end 34 will serve to "pull" the arrow 70 outwardly of the interior of the tubular member 32 during launching. In the preferred embodiment of the present invention, the arrow 70 will have a length which is less than the distance between the handle 24 of the bow 12 and the drawstring 28. As such, the present invention eliminates the need for the long arrows which are used with conventional bow-and-arrow designs. Furthermore, by the configuration of the present invention, the arrow 70 can have its shaft 74 taper and narrow along its length within the interior of the tubular member 32. It is not necessary that the shaft 74 have a consistent diameter along its length. This short tapered design of the arrow 70 allows the arrow to be lighter, less subject to wind resistance, and allows the arrow to be projected with greater velocity than conventional arrow designs. This results in less of an arc during flight and, hence, greater target accuracy. The arrow will travel greater distances than conventional arrows.

The arrow 70 can be formed of a rigid plastic material, plastic tubing, or soda straw material. The shaft 74 does not have to be very strong since the arrow is "pulled" out of the tubular member. The only strength requirement is that the shaft 74 be strong enough to carry the fletchings.

Figure 5:
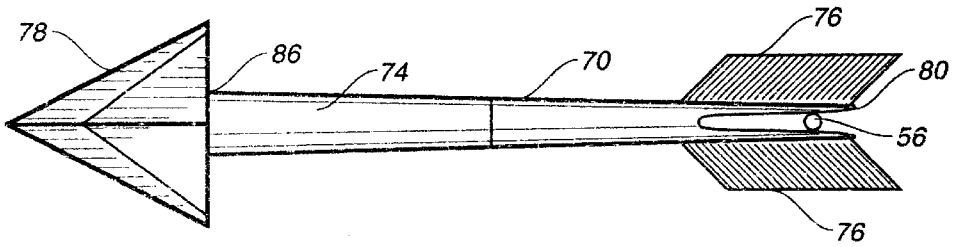
FIG. 5 is an isolated view of an arrow that can be used with the improved archery bow of the present invention.

FIG. 5 is an isolated view of the arrow 70. It can be seen that the arrow 70 includes fletchings 76 which extend radially outwardly of the shaft 74. Head 78 is affixed to an end 86 of the shaft 74. In an alternative form of the present invention, the head 78 can be threadedly secured to the end 86 of shaft 74. As such, the present invention would be adaptable to various forms of arrow heads. A nock 80 is formed at the end of shaft 74. As seen in FIG. 5, the nock 80 releasably receives the pin 56.

Figure 6:
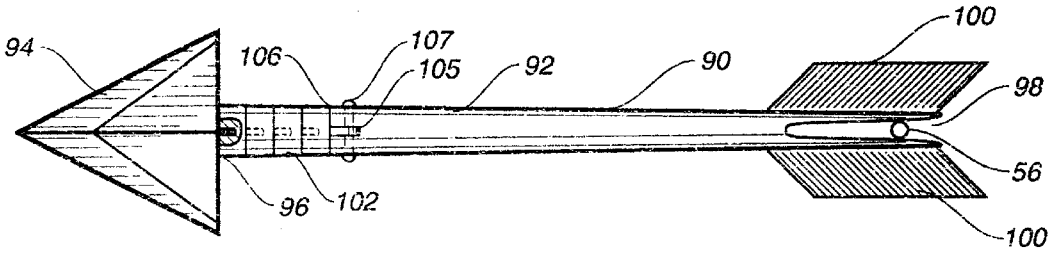
FIG. 6 is a side elevational view of an alternative arrow that can be used with the archery bow of the present invention.

FIG. 6 shows another form of arrow 90 that can be used with the present invention. In FIG. 6, it can be seen that arrow 90 includes a shaft 92 with a head 94 removably affixed to end 96 of shaft 92. Nock 98 is formed at the end of the shaft 92 opposite the head 94. Fletchings 100 extend outwardly radially. Importantly, in FIG. 6, it can be seen that weighted members 102 are secured, by threads, to the head 94. The end 105 of the weighted members 102 is threadedly received by the end of the shaft 92. Each of the weighted members 102 is threadedly received by an adjacent weighted member. In this configuration, the head 94 is spaced from the end of shaft 92 by the length of weighted members 102. It can be seen that weighted member 106 is permanently secured to the shaft 92 by fixed pin 107. The fixed pin 107 is used since repeated use could pull the end 105 from the end of shaft 92. The number of interconnected weighted members 102 is selectable according to the desires of the user. As such, the arrow 90 is adapted so as to allow for various weights to be attached to the shaft 92. The weights 102 allow the arrow 90 to exert varying amounts of foot-pounds of energy when striking the desired target. If it is desired to strike a solid target, then greater weight should be added to the shaft 92 of arrow 90. If greater speed and distance is desired, then the weights 102 can be removed from the surface of the shaft 92. As such, the apparatus of the present invention facilitates the ability to adapt the arrow 90 to various requirements. It is not necessary to change out the entire arrow.

The present invention achieves many advantages over conventional bow-and-arrow designs. Most importantly, since the present invention uses relatively small short light-weight arrows, there is no "arrow bending" upon launching. Existing bow-and-arrow designs require a lengthy shaft so as to allow the shaft to extend between the handle and the drawstring of the bow. Upon launching, the arrow will tend to flutter and bend. By allowing a shorter, more rigid, arrow to be used, a straighter and flatter path of travel can be achieved. This straighter path of travel will assure greater accuracy to the archer or bow hunter. The use of the lighter arrow will achieve greater velocity upon launching.

The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents.

I claim:

1. An improved archery bow and drawstring, the improvement comprising:

a ring-like member attached to the bow; and a tubular member slidably received within said ring-like member, said tubular member having an open end opening outwardly of the bow and the ring-like member, said tubular member being fixedly secured to the drawstring at an end opposite said open end, said tubular member having a pin formed therein so as to extend transverse to a longitudinal axis of said tubular member.

2. The improvement of claim 1, said ring-like member affixed to a handle of the bow in an area between an upper limb and a lower limb of the bow.

3. The improvement of claim 1, said ring-like member having an interior with a longitudinal axis being coaxial with a longitudinal axis of said tubular member.

4. The improvement of claim 1, further comprising:

a first fitting affixed to the drawstring above said tubular member; and a second fitting affixed to the drawstring below said tubular member, said first and second fittings adapted to fix a position of said tubular member along a length of the drawstring.

5. The improvement of claim 1, said tubular member having a solid area at said end opposite said open end, said solid area having a cavity formed around the drawstring.

6. The improvement of claim 5, said cavity having a generally V-shaped configuration on one side of said cavity.

7. The improvement of claim 6, said cavity having a straight side opposite said V-shaped configuration.

8. The improvement of claim 1, further comprising:

an arrow having a shaft slidably received within an interior of said tubular member, said arrow having a head extending outwardly of said open end.

9. The improvement of claim 8, said arrow having a nock releasably received over said pin on said interior of said tubular member.

10. The improvement of claim 8, said arrow having fletchings extending radially outwardly of said shaft, said fletchings contacting an inner wall of said tubular member.

11. The improvement of claim 8, said shaft having a length less than a distance of a handle of the bow from the drawstring.

12. The improvement of claim 8, said head being detachably affixed to said shaft, said arrow having a weighted member affixed to said shaft rearwardly of said head.

13. An archery apparatus comprising:

a bow having an upper limb and a lower limb, said bow having a handle formed between said upper limb and said lower limb, a drawstring connected to said bow so as to extend rearwardly of said handle;

a tubular member having an open end and another end affixed to said drawstring, said tubular member having an interior suitable for receipt of an arrow therein; and a receptacle affixed to said handle of said bow, said tubular member slidably received within said receptacle, said open end of said tubular member extending outwardly of said receptacle, said drawstring movable between a post-launching position and a pre-launching position, said open end being proximal said receptacle when said drawstring is in said pre-launching position, said open end being distal said receptacle when said drawstring is in said post-launching position, said receptacle being a ring-like member, said tubular member slidably received by said ring-like member, said open end being outward of said ring-like member when said drawstring is in said pre-launching position.

14. The apparatus of claim 13, further comprising:

a first fitting affixed to said drawstring above said tubular member; and a second fitting affixed to said drawstring below said tubular member, said first and second fittings adapted so as to fix a position of said tubular member along a length of said drawstring.

15. The apparatus of claim 13, said tubular member having a solid area at said end opposite said open end, said solid area having a cavity formed around the drawstring, said drawstring having a generally V-shaped configuration on one side and a straight side opposite said V-shaped configuration.

16. The apparatus of claim 13, further comprising:

an arrow having a shaft slidably received within an interior of said tubular member, said arrow having a head extending outwardly of said open end.

17. An archery apparatus comprising:

a bow having an upper limb and a lower limb, said bow having a handle formed between said upper limb and said lower limb, a drawstring connected to said bow so as to extend rearwardly of said handle;

a tubular member having an open end and another end affixed to said drawstring, said tubular member having an interior suitable for receipt of an arrow therein; and a receptacle affixed to said handle of said bow, said tubular member slidably received within said receptacle, said open end of said tubular member extending outwardly of said receptacle; and an arrow having a shaft slidably received within an interior of said tubular member, said arrow having a head extending outwardly of said open end, said tubular member having a pin formed therein, said pin extending radially within said tubular member, said arrow having a nock releasably received by said pin.

18. The apparatus of claim 17, said arrow having fletchings extending radially outwardly of said shaft of said arrow, said fletchings contacting an inner wall of said tubular member, said shaft having a length less than a distance of said handle of said bow from said drawstring.

* * * * *